United States Patent [19]

Strandell et al.

[11] 4,268,948

[45] May 26, 1981

[54] PARTING DEVICE

[75] Inventors: Per O. Strandell, Taeby; Erik M. Thorslund, Upplands Vaesby, both of Sweden; Colin R. MacKenzie, Motherwell; Norman Smith, Wishaw, both of Scotland

[73] Assignee: British Steel Corp., London, England

[21] Appl. No.: 11,637

[22] Filed: Feb. 12, 1979

[30] Foreign Application Priority Data

Feb. 28, 1978 [GB] United Kingdom ..... 7899/78

[51] Int. Cl.[3] ..... B21B 1/44

[52] U.S. Cl. ..... 29/527.6; 72/204; 72/221

[58] Field of Search ..... 72/203, 204, 221, 325; 29/527.6; 83/875, 876, 885, 886; 93/58 ST, 58.1; 164/70; 264/163

[56] References Cited

U.S. PATENT DOCUMENTS

| | | | |
|---|---|---|---|
| 294,757 | 3/1884 | Brown | 72/221 |
| 1,977,285 | 10/1934 | McCleery | 72/221 |
| 2,711,577 | 6/1955 | Leach | 29/414 |
| 3,982,455 | 9/1976 | Bowman | 83/105 |

FOREIGN PATENT DOCUMENTS

| | | | |
|---|---|---|---|
| 2705397 | 8/1977 | Fed. Rep. of Germany | 72/204 |

*Primary Examiner*—Lowell A. Larson

*Attorney, Agent, or Firm*—Bacon & Thomas

[57] ABSTRACT

A tool for forming parting grooves in a flat, plastically deformable workpiece, especially a continuously cast steel slab in a manner which seals the internal porosity of the slab in the regions which become exposed upon division, has a working portion in the form of a ridge which is most preferably in the form of a circumferential flange on a roll; and the cross-sectional shape of the ridge or flange is that of a highly convex tip between two gently convex side faces, and optionally, or essentially if either or both of the tip and the side faces are instead straight, the angle at which the side faces are mutually inclined is 20° to 60°, the width of the tip is a given porportion of the thickness of the workpiece, and the width of the tip is specifically related to the said angle of inclination of the side faces. The height of the side faces, and their curvature and that of the tip, are also preferably within set limits.

30 Claims, 6 Drawing Figures

PARTING DEVICE

This invention relates to a device for forming parting grooves in a flat, plastically deformable, metal workpiece by pressing groove-forming tools into each of the mutually opposed flat sides of the workpiece, those portions of the tools forming the parting grooves each having the form of a ridge which, when viewed in cross section, exhibits substantially straight or slightly convexly curved flank edges which converge towards one another, which edges at their closer ends merge into a straight or curved end edge.

It has previously been proposed to divide flat, metallic workpieces, and in particular continuous steel castings of pronounced rectangular cross section, into blanks of desired dimensions with the aid of parting tools which are of wedge-shaped cross section. The parting tool can be used to form in the workpiece grooves which either pass completely through the workpiece or only partially therethrough. When the tool is used to form grooves which extend only partially through the workpiece, the blanks can be separated by cutting the workpiece, for example by means of a gas-cutter, in a plane which contains the bottom surfaces of the mutually opposed grooves formed by the groove-forming tools.

This method, could, if successful, be particularly advantageous in connection with the production of slabs by continuous casting. It would theoretically only be necessary to cast a single size of slab which could then be further processed into any one or more of a large number of different products. The production flexibility of a continuous casting installation would in this manner be greatly enhanced.

Normally, cast workpieces, such as continuous steel castings, exhibit a surface layer of fine-crystalline structure, while the interior of the workpiece is of relatively coarse-crystalline structure, and sometimes also of a porous structure. When using conventional parting tools for parting such workpieces, the fine-crystalline surface layer of the workpiece is normally penetrated in a manner such as to expose the coarse-crystalline and possibly porous material of the workpiece present in the vicinity of the parting grooves. As a result, the inner regions of steel blanks are liable to be oxidized, especially since they normally have a temperature of 700° to 1200° C. when they are separated, and this also gives rise to a risk of crack formation when the blanks are subjected to subsequent rolling operations, foundry operations or to any other work in which the blanks are subjected to plastic deformation.

A further disadvantage of the use of conventional parting tools for separating metal workpieces into blanks is the high degree of wear to which the tools are subject.

The present invention is directed to these problems and in one aspect relates to a device for forming parting grooves in a surface of a steel slab or other workpiece by rolling, comprising a work roll characterised by a circumferential flange for grooving the workpiece, the working profile of the flange comprising a highly convex tip between two gently convex side faces.

The side faces may have a straight portion in their profile between the gently convex portion and the transition to the roll body. Such straight portions are preferably inclined so as to converge towards the tip of the flange. The transitions between differently curved portions are desirably smooth.

The terms highly and gently convex are relative. Essentially the tip of the grooving roll is curved more sharply than the adjacent cheek portions. by way of illustration, the highly convex tip may be curved at a radius between one quarter and one tenth of the depth of the groove in the workpiece for which the roll is dimensioned and the gently convex side faces may be curved at a radius between one and two times the depth of the said groove.

We have found that a work roll of this shape has particular advantages as a grooving roll, especially in relation to continuously cast steel slabs, in which the internal defects are essentially small shrinkage cavities. The shape assists in sealing the cavities and eliminating porosity. At the same time it begins to separate the two parts of the slab. As long as the groove which is being rolled into the slab is not too sharp, the roll does not shear the steel but works it plastically. This is of benefit to the microstructure especially in relation to welding up the internal defects. Thus the newly exposed inner faces of the groove can be made as sound as the original faces of the slab. The less curved side faces also work the steel without widening the groove and spreading the steel to as great as extent as a straight tapered profile would.

The work roll may advantageously be dimensioned in accordance with certain specific relationships. These relationships are in fact not confined to groove-forming tools conforming to the shape of the work roll detailed above, but are applicable to all groove-forming tools of the kind described in the introduction for the purpose of eliminating, at least substantially, the aforementioned disadvantages.

In accordance with this aspect of the present invention there is provided a device for forming parting grooves in a flat plastically deformable metal workpiece by impressing tools into its opposite flat sides, the portions of the tools forming the parting grooves each having the shape of a ridge which, when viewed in cross section, has substantially straight or slightly convexly curved convergent flank edges which at their closer ends merge into a straight or curved end edge, which is characterised by the fact that the angle $\alpha$ included by the flank edges or by chords which pass through the end points of the flank edges is from 20° to 60°; that the distance $\epsilon$ between the flank edges at their points of transition into the end edge is from 0.06 to 0.20, preferably from 0.07 to 0.16, times the maximum thickness $h_o$ of the workpiece for which the device is dimensioned; and also that $\epsilon \cdot \tan \alpha/2$ exceeds 2.3 mm.

A device of such design can be relied upon not to cut through the surface layer of the workpiece when the groove-forming tools are pressed into the opposite flat sides of the workpiece. Instead, the surface layer will be drawn down into the parting grooves so as to cover the groove walls. Further, with the workpiece free to spread laterally, a parting device of this design ensures reduced friction between the groove-forming tools and the workpiece, and also, during at least the last stages of a parting operation, the sides of the grooves will no longer contact the groove-forming tools. In this way wear on the tools is reduced, as is also the risk of rupturing the outer layers of the workpiece in a manner such as to expose the internal material of the workpiece.

To enable grooves to be formed to a sufficient depth, the height of the groove-forming tools according to the invention must normally be substantially greater than the height only of those portions of the tools which come into contact with the workpiece. The specific relationships set out above relating to the design of the groove-forming tools, however, apply only to those portions of the tools which come into contact with the workpiece, while with regard to the design of the remaining parts of the tools it is necessary only to ensure that these latter parts do not come into contact with the walls of the parting grooves formed in the workpiece. In this way unnecessary friction is avoided between the workpiece and the tools, while the side edges of the blanks parted from the workpiece during the parting operation are not unduly deformed. Any further deformation of the side edges will only increase the amount of energy required to effect a separation. In order to ensure that the height of the parts of the tools coming into contact with the workpiece is adequate, the distance L between the end points of each flank edge should, in accordance with the invention, be at least 0.2, and preferably at least 0.4, times $$\frac{1}{\cos\alpha/2}\left(h_o - \frac{\epsilon}{\tan\alpha/2}\right).$$

If the flank edges are convexly curved, the radius of curvature should be greater than 2.5 L.

In order to avoid open pores which are liable to oxidation in the central region of the sides of the edges of the blanks formed during the groove-forming operation, the tools should, in accordance with the invention, be capable of being pressed into the opposite flat sides of the workpiece at least to a depth at which the distance between the said transition points of the opposed tools is not more than 0.40ε. In this way it is ensured that the pores in that part of the material located between the bottom surfaces of associated pairs of grooves will be closed and that this material will be compacted.

In accordance with the invention, the tools may comprise elongate profile elements of substantially wedge-shape when seen in cross section, which profile elements can be pressed into the opposite flat sides of the workpiece with the aid of a hydraulic press or the like. Preferably, however, the tools comprise circumferential flanges on a pair of rolls which are capable of being brought against the flat sides of the workpiece by the movement of one or both of the rolls.

When the device according to the invention comprises a work roll with circumferential grooving flanges, the roll may constitute an integral part of a more complex roll having multiple functions. Thus a larger roll can incorporate a grooving flange towards one of its ends and can be profiled at the other end for rolling half a previously slit slab into a bloom or billet section. Alternatively the grooving flange can be incorporated in a more complex roll profiled for guiding and shaping the whole slab while it is beng grooved.

The invention also provides a rolling mill stand having a pair of opposed work rolls for rolling a groove into a workpiece, in which at least one work roll is of this kind. The mill stand will normally have two such rolls set one above the other with their axes parallel and horizontal. The two rolls can be rotated in opposite directions so as to groove both sides of a slab as it passes between the co-operating rolls. Other roll arrangements are however quite possible. The rolling mill stand may incorporate support means and guide means for the slab, so as to control its passage through he mill. These means may suitably take the form of fixed or adjustable entry and exit tables or vertical edging rolls. The gap between the rolls will normally be adjustable so that the slab can be grooved progressively in several passes through the mill.

The invention also provides a process for forming parting grooves in a flat plastically deformable workpiece, for example, a steel slab or other shape, by impressing the grooving device into its opposite flat sides. Thus a steel slab may be divided longitudinally into narrower shapes by a method which comprises grooving the slab with a device or in a rolling mill stand according to the invention before the parts are separated.

Final separation may be by flame cutting or by other methods. It is possible to separate the parts by continued deepening of the grooves by the same grooving process, such as rolling with a grooving roll.

This process is preferably applied to a continuously cast steel slab in which case the grooving process is accomplished in a manner which seals the integral porosity of the slab in the regions which are to become exposed on division.

Several embodiments of the invention are illustrated by way of example in the accompanying drawings, in which.

Figure 1:
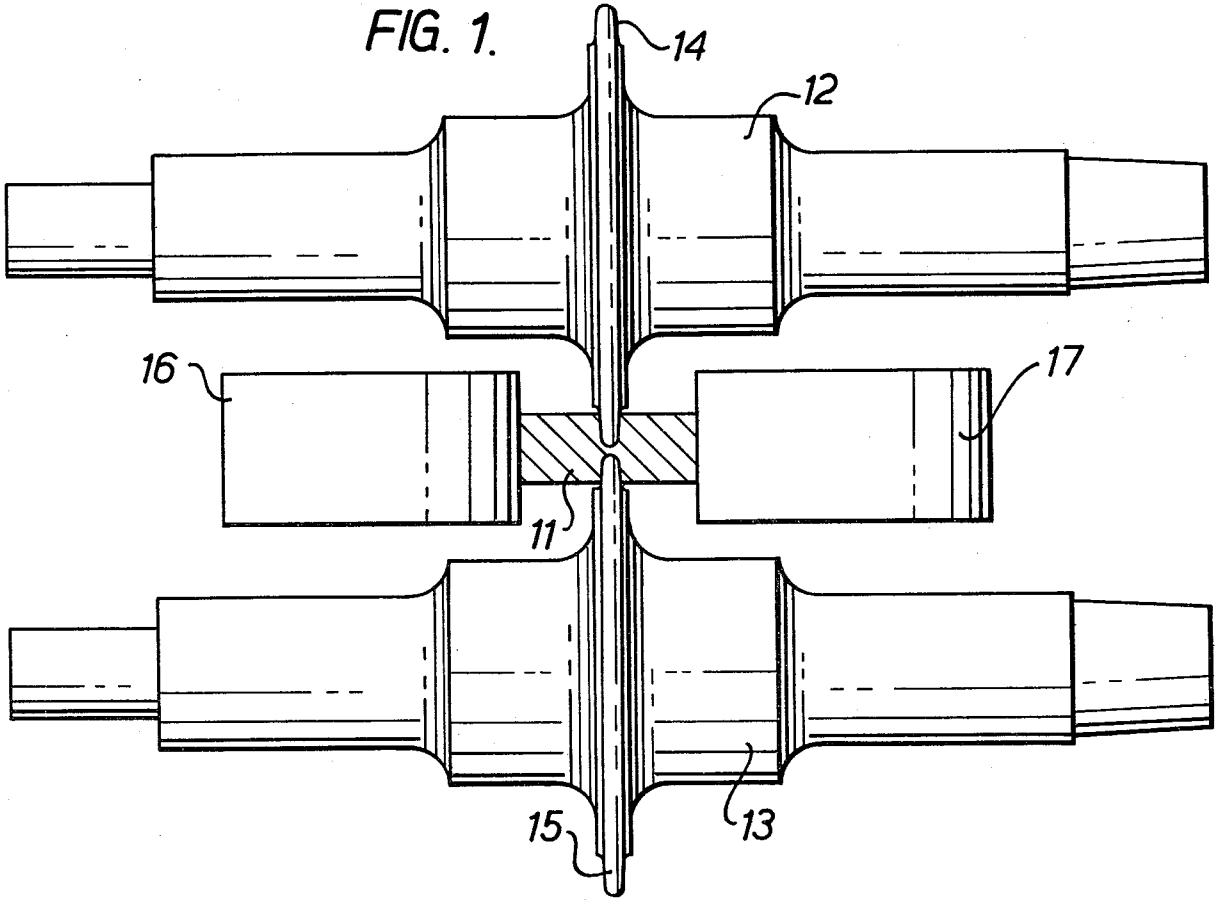
FIG. 1 shows a cross section through a slab being grooved in a rolling mill stand, of which only the rolls are shown for the sake of clarity.
Figure 2:
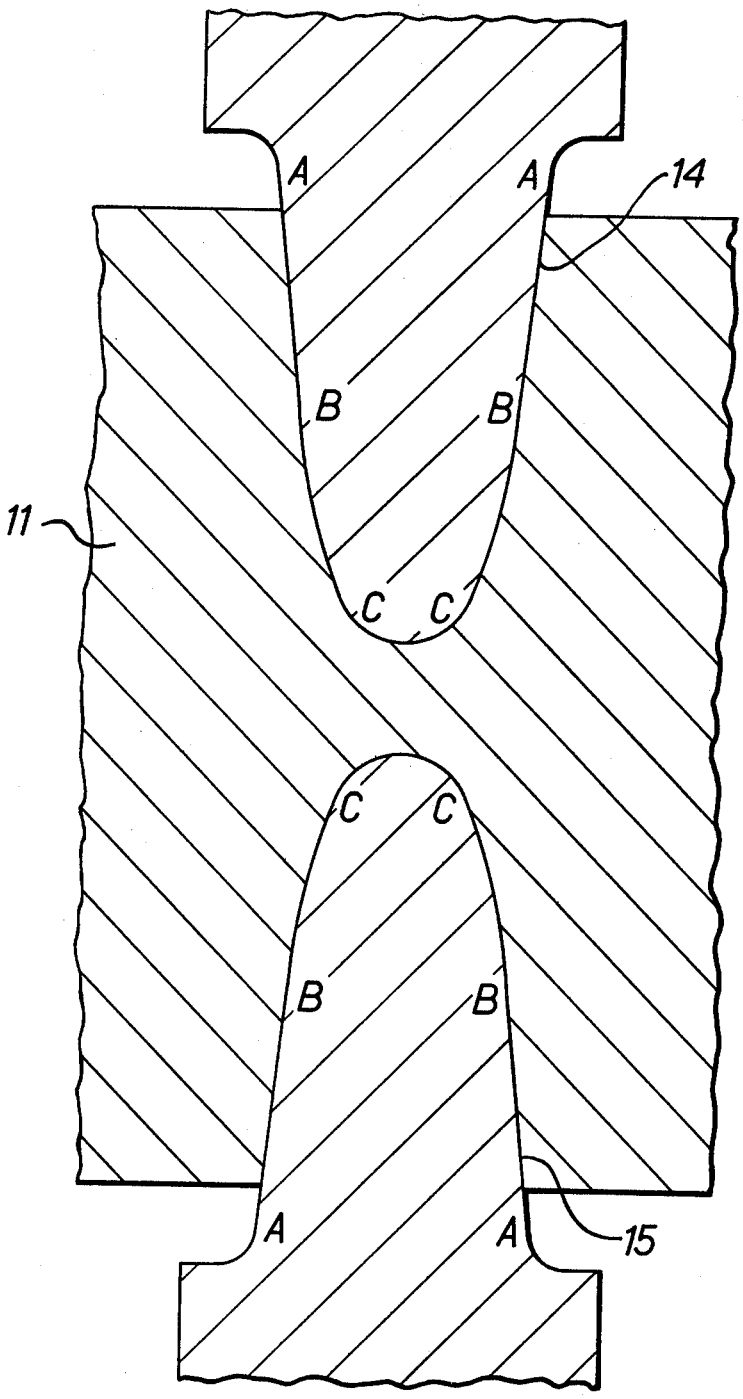
FIG. 2 shows part of the same cross section and the working profiles of the grooving rolls also in cross section, to an enlarged scale.

In FIGS. 1 and 2 of the drawings a hot continuously cast steel slab 11 with a width approximately twice its height is shown passing through a rolling mill stand having a universal-type layout. A pair of identical horizontal work rolls 12 and 13, which are disposed one above the other and have grooving flanges 14 and 15 respectively, co-operate to form grooves centrally in the upper and lower surfaces of the slab as a first stage in dividing the slab into two approximately square section billets. A pair of vertical rolls 16 and 17 serve to support the sides of the slab or entry and thereby guide the slab as it passes through the mill. These vertical rolls do not reduce the width of the slab.

The slab as they are not in the same plane as the axes of rolls 12, 13 in the drawings 11 passes several times through the mill in order that grooves of the necessary depth may be rolled. After each pass until the final pass the rolls 12 and 13 are advanced towards each other to reduce the gap between the grooving flanges 14 and 15. FIGS. 1 and 2 show the depths of the grooves on the final pass of the slab through the mill.

After this pass the slab is finally divided by flame cutting. Because of the deep grooves that are now present in the slab, only a small amount of steel is lost as fume and slag arising from the flame cutting process.

The flanges 14 and 15 are better shown in FIG. 2. The tips of the working profiles between the pairs of points marked C are curved convexly to a radius of about 16 mm. On either side of the tip of each grooving roll between the points marked C and B the profiles are curved convexly to a radius of about 150 mm, with a smooth transition between the radii at the points C. At the points B the profiles undergo another smooth transition to straight tapered portions extending back to the points marked A, which are at the roots of the grooving elements. The taper is at an angle of about 6° on each side of each grooving flange.

The grooves are rolled to a depth of about 100 mm, each in a slab of 225 mm thickness.

Figure 3:
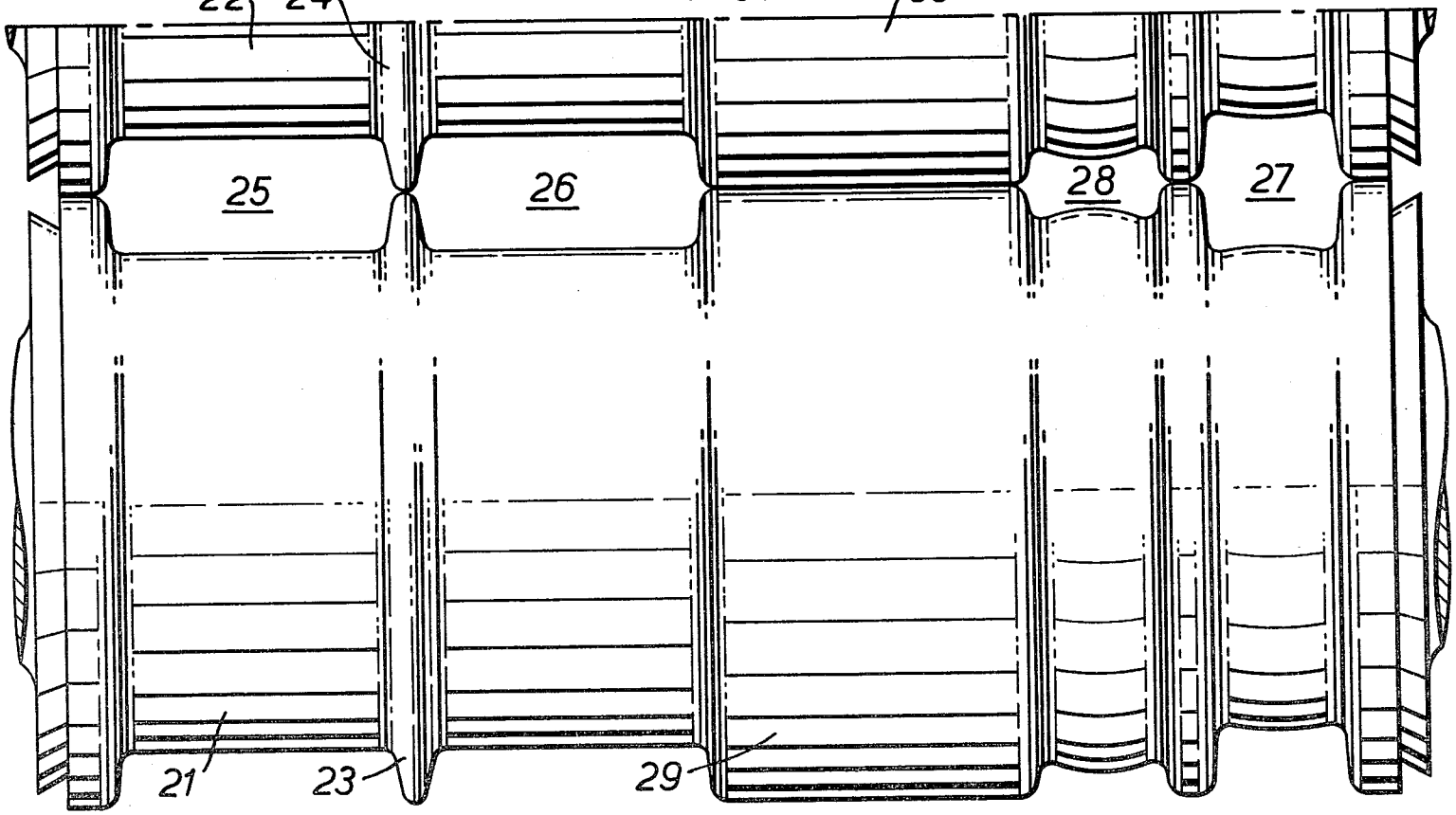
FIG. 3 shows part of a pair of rolls of a more complex shape.

The rolls shown in FIG. 3 are combined grooving and edging rolls. They are suitable for use in dividing a wider slab than that shown in FIGS. 1 and 2. In this example the slab is of the same thickness, 225 mm., but is 1000 mm. wide. After longitudinal division each half of the slab still needs to be reduced in width by over 50 percent in order to achieve a square billet section. This reduction is carried out by edge rolling after turning each half slab on its side. Grooving and slitting take place at one end of the rolls and edge rolling takes place towards the other end of the rolls.

The two rolls 21 and 22 each carrying grooving flanges 23 and 24 respectively which are the same shape and size as the flanges 14 and 15 shown in FIG. 2. These grooving flanges 23 and 24 divide a box pass into two portions 25 and 26 each about 550 mm. wide. A slab entering the box pass can consequently be progressively grooved by the grooving flanges in successive passes between the rolls as the roll gap is gradually closed. The slab is well supported within the pass and may be completely separated in this manner.

These two co-operating rolls also define passes 27 and 28 in which each half of the divided slab can be edge rolled after having previously been rotated through 90°. The rolls carry raised flat portions 29 and 30 in which the half slabs can periodically be rolled on their longer sides to control their shapes between successive edge rolling passes. In this way each half of the divided slab can be rolled into a 225 mm. square billet section.

By rolling the grooves in this manner it has been found that the internal defects in the continously cast slab in the regions adjacent to the grooves can be closed, so that the two billets formed by the division of the slab are essentially free from surface cracks on all four side faces and no significant differences between the side faces become apparent during subsequent processing.

Figure 4:
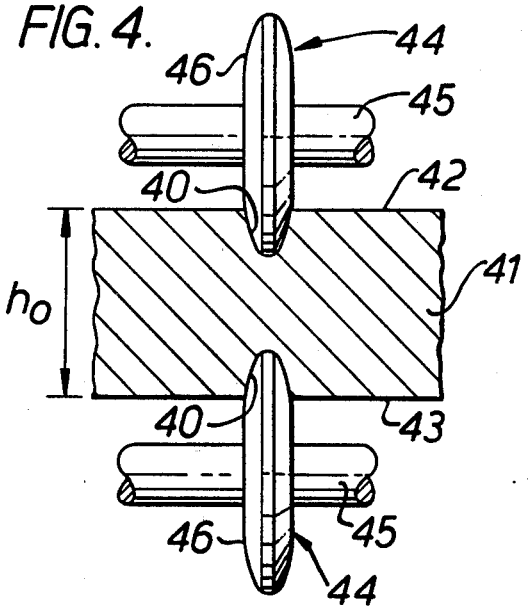
FIG. 4 shows schematically a device illustrating the specific relationships to which groove-forming tools may be dimensioned according to the invention, in the form of a roll.

To assist in an understanding of the specific dimensional relationships to be found in the preferred embodiments of the invention, FIG. 4 illustrates a further device for forming parting grooves 40 in a flat workpiece 41, the thickness or height of which is designated $h_o$. The device comprises a pair of tools in the form of rolls 44 capable of being brought against a respective flat surface 42,43 of the workpiece. The rolls 44 comprise shafts 45 which are driven by means not shown and on the roll shafts are roll bodies 46 in the form of flange-like devices adapted to form parting grooves 40 in flat surfaces 42, 43.

Figure 5:
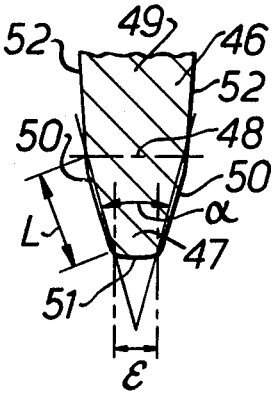
FIG. 5 is a cross sectional view, to a larger scale, of one of the rolls shown in FIG. 4.

As will be seen more clearly from FIG. 5, the roll bodies 46 can be considered to comprise an outer, annular, ridge-like portion 47 which merges with an inner annular portion 49 on the line 48, said portion 49 being located between the portion 47 and the associated roll shaft 45, the radial extent of the portion 49 being so adapted that the portion 47 can penetrate the workpiece 41 to the depth required. When seen in cross section, the portion 47 is defined by slightly curved flank edges 50 and a curved end edge 51. Extensions of chords drawn through the end points of the flank edges 50 enclose an angle which is designated $\alpha$ in FIG. 5, the length of the chords being designated L. Further, the distance between those points at which the flank edges 50 merge with the end edge 51 is designated $\epsilon$. The flank edges 52 of the portion 49 are also slightly curved, the extensions of chords through the end portions of the flank edges 52 enclosing an angle which is at most equal to the angle $\alpha$. The radius of curvature of the end edges 51 should exceed $$\frac{\epsilon}{2\cos\alpha/2}.$$

In order to fulfil the objects mentioned in the introduction the portion 47 is formed so that chords through the end points of the flank edges 50 include an angle $\alpha$ of from 20° to 60°, so that $\alpha$ is from 0.06 $h_o$ to 0.20 $h_o$, and so that $\epsilon \cdot \tan \alpha/2$ is greater than 2.3 mm. Further the distance L between the end points of each flank edge 50 should be at least 0.2 times $$\frac{1}{\cos\alpha/2}\left(h_o - \frac{\epsilon}{\tan\alpha/2}\right),$$

and the radius of curvature of the flank edges should be greater than 2.5 L. Further, the radial extent of the roll bodies 46, measured from the associated roll shafts to the locations at which the flank edges 50 merge with the end edge 51, should be sufficient to permit the formation of grooves 40 of such depth that the distance between opposing groove bottoms is not more than 0.40$\epsilon$.

The tools shown in FIGS. 1 to 3 conform to these preferred dimensions.

The grooves are formed in the workpiece with the aid of flanged rolls by rolling the workpiece in several passes, the maximum penetration of the rolls per pass being determined by the angle of bite in the roll gap. The extent of which the roll bodies penetrate the workpiece per pass is restricted, however, so as to avoid unintentional tearing apart of the workpiece in the region of the grooves.

Figure 6:
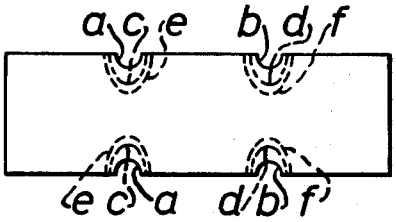
FIG. 6 illustrates a preferred method of using the invention for forming more than one pair of parting grooves in a workpiece.

The workpiece can be parted by the device according to the invention without any substantial lateral bending of the workpiece, provided that either the opposing grooves are exactly central, i.e. are equidistant from the side edges of the workpiece, or the grooves are formed within a central region of the workpiece whose lateral extent is 20% of the total lateral extent of the workpiece. When dividing a workpiece 41 into an uneven number of blanks, for example three blanks, such as is shown in FIG. 6, such lateral outward bending of the workpiece can be largely avoided when using only one pair of tools by carrying out the passes in the sequence a, b, c, d, e, f, etc. in the manner illustrated in FIG. 6. In this case two opposed pairs of parting grooves are impressed by a single pair of tools, each pair of grooves being impressed in a number of discrete passes alternately at the location of one pair of grooves and at the location of the other. The total penetration per pass in this case should be not more than 30% of the total thickness or height of the workpiece in the first pass and not more than 30% of the remaining distance between the bottoms of the opposing grooves 40 in subsequent passes.

We claim:

1. A device for forming parting grooves in a flat plastically deformable metal workpiece having a maximum thickness of $h_o$ by impressing tools into its opposite flat sides and permitting lateral spread of the workpiece, the portions of the tools forming the parting grooves each having the shape of a ridge which, when viewed in cross section, has substantially straight or slightly convexly curved convergent flank edges which at their closer ends merge into a straight or curved end edge, wherein the angle $\alpha$ included by chords through the end points of the flank edges is from 20° to 60°, the distance $\epsilon$ between the flank edges at their points of transition into the end edge is from 0.06 to 0.20, preferably from 0.07 to 0.16, times the maximum thickness $h_o$ and also $\epsilon \cdot \tan \alpha/2$ exceeds 2.3 mm.

2. A device as claimed in claim 1, wherein the distance L between the end points of each flank edge is at least 0.2, preferably at least 0.4, times $$\frac{1}{\cos\alpha/2}\left(h_o - \frac{\epsilon}{\tan\alpha/2}\right)$$

3. A device as claimed in claim 1 wherein the tools are capable of being pressed into the opposite flat sides of the workpiece at least to a depth where the distance between said transition points of the opposed tools is not more than 0.40 $\epsilon$.

4. A device as claimed in claim 1 wherein the radius of curvature of the end edge is greater than $$\frac{\epsilon}{2\cos\alpha/2}.$$

5. A device as claimed in any one of the preceding claims wherein the tools comprise circumferential flanges on a pair of rolls adapted to press against opposite flat sides of the workpiece to form parting grooves therein.

6. A device as claimed in claim 5 wherein each roll incorporates the grooving flange towards one of its ends and is profiled at the other end for rolling half a previously slit slab into a bloom or billet section.

7. A device as claimed in claim 5 wherein each roll is also provided for guiding and supporting a whole slab while it is being grooved, for example by constraining the two edges of the slab in a box pass in order to restrain its lateral spread within limits and to guide and support it as it passes between a pair of co-operating grooving rolls.

8. A device as claimed in claim 5 in the form of a rolling mill stand having a pair of opposed work rolls for rolling a groove into a workpiece, at least one of the work rolls being the said circumferentially flanged tool.

9. A device as claimed in claim 1, wherein the convergent flank edges are convexly curved such that the radius of curvature exceeds 2.5 L and wherein the distance L between the end points of each flank edge is at least 0.2, preferably at least 0.4, times $$\frac{1}{\cos\alpha/2}\left(h_o - \frac{\epsilon}{\tan\alpha/2}\right).$$

10. A device for forming parting grooves in a surface of a steel slab or other workpiece by rolling, comprising a work roll having a circumferential flange for grooving the workpiece and permitting lateral spread thereof, the working profile of the flange comprising a highly convex tip between two gently convex side faces.

11. A device as claimed in claim 10 wherein the side faces of the flange have a straight portion in their profile between the gently convex portion and the transition to the roll body.

12. A device as claimed in claim 11 wherein the said straight portions are inclined so as to converge towards the tip of the flange.

13. A device as claimed in any one of claims 10 to 12, wherein the highly convex tip is curved at a radius between one quarter and one tenth of the depth of the groove in the workpiece for which the roll is dimensioned and the gently convex side faces are curved at a radius between one and two times the depth of the said groove.

14. A device as claimed in claim 13 dimensioned for a groove about 100 mm deep, wherein the radius of curvature of the tip is about 16 mm and the radius of curvature of the gently convex side face is about 150 mm.

15. A device as claimed in any one of claims 10 to 12 wherein the roll incorporates the grooving flange towards one of its ends and is profiled at the other end for rolling half a previously slit slab into a bloom or billet section.

16. A device as claimed in any one of claims 10 to 12 wherein the roll is also profiled for guiding and supporting a whole slab while it is being grooved, for example by constraining the two edges of the slab in a box pass in order to restrain its lateral spread within limits and to guide and support it as it passes between a pair of cooperating grooving rolls.

17. A device as claimed in any one of claims 10 to 12 in the form of a rolling mill stand having a pair of opposed work rolls for rolling a groove into a workpiece, at least one of the work rolls being the said circumferentially flanged roll.

18. A process for forming parting grooves in a flat plastically deformable metal workpiece having a maximum thickness of $h_o$, comprising the steps of impressing tools into its opposite flat sides and permitting lateral spread of the workpiece, the portions of the tools forming the parting grooves each having the shape of a ridge which, when viewed in cross section, has substantially straight or slightly convexly curved convergent flank edges which at their closer ends merge into a straight or curved end edge, wherein the angle $\alpha$ included by chords through the end points of the flank edges is from 20° to 60°, the distance $\epsilon$ between the flank edges at their points of transition into the end edge is from 0.06 to 0.20, preferably from 0.07 to 0.16, times the maximum thickness $h_o$, and also $\epsilon \cdot \tan \alpha/2$ exceeds 2.3 mm.

19. A process as claimed in claim 18, wherein the distance L between the end points of each flank edge is at least 0.2, preferably at least 0.4, times $$\frac{1}{\cos\alpha/2}\left(h_o - \frac{\epsilon}{\tan\alpha/2}\right).$$

20. A process as claimed in claim 18, wherein the convergent flank edges are convexly curved such that the radius of curvature exceeds 2.5 L and wherein the distance L between the end points of each flank edge is at least 0.2, preferably at least 0.4, times $$\frac{1}{\cos\alpha/2}\left(h_o - \frac{\epsilon}{\tan\alpha/2}\right).$$

21. A process as claimed in claim 18 wherein the tools are pressed into the opposite flat sides of the workpiece at least to a depth where the distance between said transition points of the opposed tools is not more than $0.40\epsilon$.

22. A process as claimed in claim 18 wherein the radius of curvature of the end edge is greater than $$\frac{\epsilon}{2\cos\alpha/2}.$$

23. A process for forming parting grooves in a surface of a steel slab or other workpiece comprising the step of rolling the workpiece with a work roll having a circumferential flange for grooving the workpiece and permitting lateral spread thereof, the working profile of the flange comprising a highly convex tip between two gently convex side faces.

24. A process as claimed in claim 23 wherein the side faces of the flange have a straight portion in their profile between the gently convex portion and the transition to the roll body.

25. A process as claimed in claim 24 wherein the said straight portions are inclined so as to converge towards the tip of the flange.

26. A process as claimed in any one of claims 18 to 25 comprising, providing the workpiece with two opposed pairs of parting grooves by means of a single pair of grooving tools, the pairs of grooves are each impressed in a number of discrete passes alternately at the location of one pair of grooves and at the location of the other and the penetration in each pass is not more than 30% of the residual thickness of the workpiece at the location of the groove.

27. A process for dividing a steel slab by forming parting grooves therein and subsequently separating the parts of the slab along the grooves, wherein the parting grooves are formed by a process as claimed in any one of claims 18 to 25 and comprising the additional step of separating the parts of the workpiece by continued deepening of the grooves by the same process.

28. A process as claimed in claim 27 comprising continuously casting the steel slab and grooving the slab so as to seal the internal porosity of the slab in the regions which become exposed upon division.

29. A process for dividing a steel slab by forming parting grooves therein and subsequently separating the parts of the slab along the grooves, wherein the parting grooves are formed by a process as claimed in any one of claims 18 to 25 and comprising the additional steps of separating the parts of the workpiece by flame cutting.

30. A process as claimed in claim 29 comprising continuously casting the steel slab and grooving the slab so as to seal the internal porosity of the slab in the regions which become exposed upon division.

* * * * *